United States Patent [19]

O'Neal et al.

[11] Patent Number: 4,958,605

[45] Date of Patent: Sep. 25, 1990

[54] FUEL INJECTION NOZZLE

[75] Inventors: Glenn B. O'Neal; Quentin A. Baker; Henry E. Mecredy, III, all of San Antonio, Tex.; Daniele Terna, Milan, Italy

[73] Assignee: Euron S.p.A., Milan, Italy

[21] Appl. No.: 335,282

[22] Filed: Apr. 10, 1989

[51] Int. Cl.[5] ..... F02B 3/10; F02M 45/08; F02M 61/06

[52] U.S. Cl. ..... 123/300; 239/533.4

[58] Field of Search ..... 123/299, 300; 239/533.3, 533.4, 533.5–533.12

[56] References Cited

U.S. PATENT DOCUMENTS

| | | | |
|---|---|---|---|
| 4,022,165 | 5/1977 | Eckert et al. | 123/300 |
| 4,691,674 | 9/1987 | Otsuka et al. | 123/299 |
| 4,796,577 | 1/1989 | Baranescu | 123/300 |
| 4,848,668 | 7/1989 | Andrews et al. | 239/533.5 |
| 4,856,713 | 8/1989 | Burnett | 123/300 |
| 4,889,288 | 12/1989 | Gaskell | 239/533.5 |

FOREIGN PATENT DOCUMENTS

| | | | |
|---|---|---|---|
| 759420 | 11/1953 | Fed. Rep. of Germany | 239/533.3 |
| 975205 | 10/1950 | France | 239/533.5 |
| 522666 | 6/1940 | United Kingdom | 239/533.5 |

*Primary Examiner*—Tony M. Argenbright
*Assistant Examiner*—Robert E. Mates
*Attorney, Agent, or Firm*—Hedman, Gibson, Costigan & Hoare

[57] ABSTRACT

A fuel injection nozzle including a valve having an axial hole therethrough for feeding a first fuel to a collection zone and having a pathway for alternately feeding a second fuel to the same or different collection zone to enable the single nozzle to inject separate streams of each fuel into a compression ignition engine combustion chamber.

17 Claims, 5 Drawing Sheets

FUEL INJECTION NOZZLE

FIELD OF THE INVENTION

The present invention is directed to a fuel injection nozzle particularly suited for compression-ignition engines and to a novel valve used in conjunction therewith to provide an atomized supply of primary and pilot fuels into the compression-ignition chamber of the engine.

BACKGROUND OF THE INVENTION

Standard practice in the operation of a compression-ignition engine is to introduce the liquid fuel into the combustion chamber at high pressures near the end of the compression stroke of the piston. This promotes rapid mixing and evaporation of the fuel and leads to autoignition and combustion with the air previously inducted into the chamber. Autoignition refers to the condition wherein the fuel spontaneously ignites under the temperature and pressure conditions existing within the chamber.

Fuels which readily ignite under the conditions within the chamber require only a single nozzle for injection of the fuel into the chamber, as in most standard diesel combustion engines.

Some fuels, however, such as methanol and ethanol do not readily autoignite. Such fuels possess desirable properties such as low exhaust emissions which make them desirable fuels for combustion engines. Thus, efforts have been made to promote ignition of these fuels.

It is known that ignition can be promoted with an injection of a small amount of a readily ignitable fuel such as diesel fuel. Typically, these so called "pilot fuels" are injected into the combustion chamber in advance of the primary fuel injection. Under the conditions of the combustion chamber, the pilot fuel ignites which causes ignition and combustion of the primary fuel.

It is also known to inject a single fuel of uniform composition but poor ignition quality into an engine using double injection for each combustion event. Such staged or "staggered" injection systems also employ an injection of pilot fuel in advance of the main injection, allowing the injected pilot fuel to undergo physical and chemical conditioning and to ignite. This aids the ignition and combustion of the main fuel charge having the identical chemical composition. This system is particularly suited for fuels having poor ignition quality.

In order to introduce both the primary and pilot fuels to the combustion chamber, it is known to use two separate and independent fuel injection systems. Each system is provided with its own means of pressurizing the fuel and injecting the fuel into the combustion chamber as an atomized spray. Specifically, one of the fuel injection systems will have a nozzle particularly suited for injecting the primary fuel and the other the pilot fuel.

One of the disadvantages of a two nozzle system is that under typical operating conditions it is preferred to introduce the fuel at or near the physical center of the combustion chamber. The center of the combustion chamber is usually occupied by the primary fuel nozzle so that the pilot fuel nozzle must be placed in a less desirable location at the periphery of the chamber.

It is desirable to be able to convert an engine from one which is powered by an autoignitable fuel such as diesel fuel to one which can use a non-autoignitable fuel such as methanol and ethanol in order to avoid the cost of producing two different types of engines.

However, such conversion is rendered difficult and costly when a one nozzle system is converted to a two nozzle system since it is often necessary to modify major parts of the engine including the cylinder head.

It would therefore be desirable to provide a fuel injection system which can meter two different fuels to the combustion chamber through the same nozzle, and which can readily be removed and replaced by a system for injecting only a single fuel to the chamber.

It is therefore an object of the present invention to provide a fuel injection system for injecting both a primary and pilot fuel from a single nozzle into a combustion chamber.

It is another object of the invention to provide a fuel injection system which may be readily installed and removed from an engine.

It is a further object of the invention to employ a novel valve within the nozzle which enables one of the fuels to be transported through the valve.

SUMMARY OF THE INVENTION

The present invention is generally directed to a fuel injection system including means for alternately conveying respective fuels through a nozzle and into a compression-ignition engine combustion chamber in the form of a spray suitable for ignition under the temperature and compression conditions of the chamber.

Specifically, the system comprises separate intake means for separately receiving at least two different fuels. One of the intake means may be adapted to receive the primary fuel and the other intake means the pilot fuel.

There is also provided a cavity within the nozzle which is in flow communication with each of the intake means. The cavity has respective openings for receiving each of the fuels.

Valve means is provided within the cavity. The valve means is movable within the cavity and sealingly engages the wall of the cavity in such a manner as to form one zone where both fuels are alternately collected under pressure, or separate zones above and below the seal, where each of the respective fuels are separately collected. In the former arrangement, when the pressure is increased to a certain level, the valve means moves out of engagement with the cavity wall and thereby releases the fuel. The released fuel exits the cavity via an injection means which serves to atomize the fuel under pressure and to direct the atomized fuel into the compression ignition engine combustion chamber. Releasing the fuel causes the valve means to return to its sealed position against the cavity wall so that the collection zone is reformed to receive the next fuel charge.

In the latter arrangement, the valve means is structured to permit one of the fuels, e.g, the pilot fuel, to be discharged directly into an injection sac (i.e. the collection zone formed below the seal) which is proximate to the injection means.

In this embodiment the pilot fuel is discharged from the valve means to a separate collection zone below the seal formed by the valve means and the cavity wall. Since the collection zone below the seal is proximate to the injection means, the valve means does not need to disengage from the cavity wall in order to release the fuel into the combustion chamber. In this way, the respective fuels are more effectively prevented from mixing.

The valve means is provided with an axial channel having an entry port at its upper end which is in flow communication with an appropriate opening in the cavity. At the bottom end of the valve means is an exit port adapted to release the fuel received from the axial channel under pressure into the collection zone either above or below the seal.

In operation, the first fuel (e.g. a pilot fuel) is supplied to the corresponding intake means under pressure from a pump at a time when the valve means is in sealing engagement with the cavity wall. The pilot fuel is sent to a collection zone either above or below the seal. At that time, the second fuel is prevented from entering the cavity.

The opening is positioned in proximity to the valve means such that the pilot fuel is able to pass directly into the axial channel and flow out of the exit port into one of the collection zones. In the embodiment using a single collection zone, the pilot fuel collects under pressure until it forces the valve means to disengage from the cavity wall. As result, the first fuel flows through the space between the disengaged valve means and cavity wall into the injection means where it is passed as an atomized spray into the compression ignition engine combustion chamber. In the two collection zone embodiment case, the pilot fuel flows directly into the collection zone below the seal and through the injection means into the chamber.

When the collection zone is emptied of the pilot fuel, the second fuel or primary fuel is then sent under pressure through the second intake means into the collection zone above the seal. Once the collection zone for the primary fuel is substantially filled it causes pressure to be exerted against the valve means forcing it to disengage from the cavity wall to thereby create an opening allowing the fuel to flow under pressure out of the collection zone and through the injection means as an atomized fuel. Once the primary fuel has been injected in this manner, the pressure against the valve means subsides enabling the valve means to reengage the cavity wall in sealed relationship to again form the collection zone ready to receive the next fuel charge.

The fuel injection system of the present invention therefore provides for the injection of two fuels into the compression-ignition chamber using only a single nozzle. This system can readily be replaced by a single nozzle system particularly suited for injecting a single type of fuel without significant cost and modification of the engine.

In addition, the fuel injection system of the present invention may be adapted to a "staggered" injection system. For example, a pilot fuel may be injected into the chamber as previously described followed by an injection of the primary fuel charge having the same composition as the pilot fuel. It is also possible in accordance with the present invention to inject multiple charges of the same fuel.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 1:
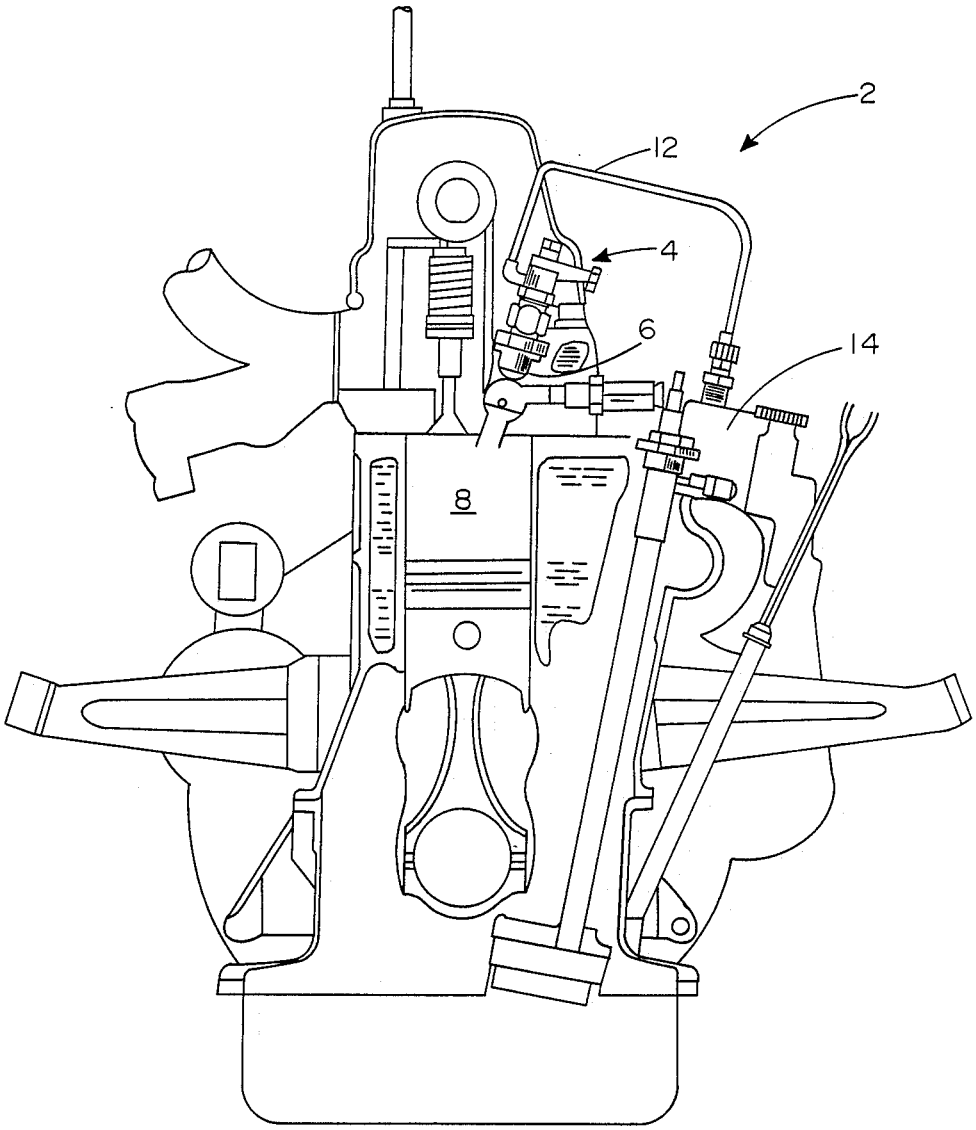
FIG. 1 is a perspective view of a known fuel injection assembly in a diesel engine showing a single nozzle.

Referring to the drawings and particularly to the prior art as represented by FIG. 1, a diesel engine 2 contains a fuel injection system shown generally as 4 which includes a nozzle 6 which opens into a combustion chamber 8. As shown in FIG. 1 there is a single nozzle 6 for injection of only one type of fuel.

The nozzle 6 is connected via a fuel line 12 to a pump 14. When a pilot fuel is employed to aid in the ignition of a primary fuel, a second nozzle is used to inject the pilot fuel. The second nozzle is customarily provided with a separate fuel line and fuel pump and must be positioned toward the periphery of the chamber because of the central location of the primary fuel nozzle.

Figure 3:
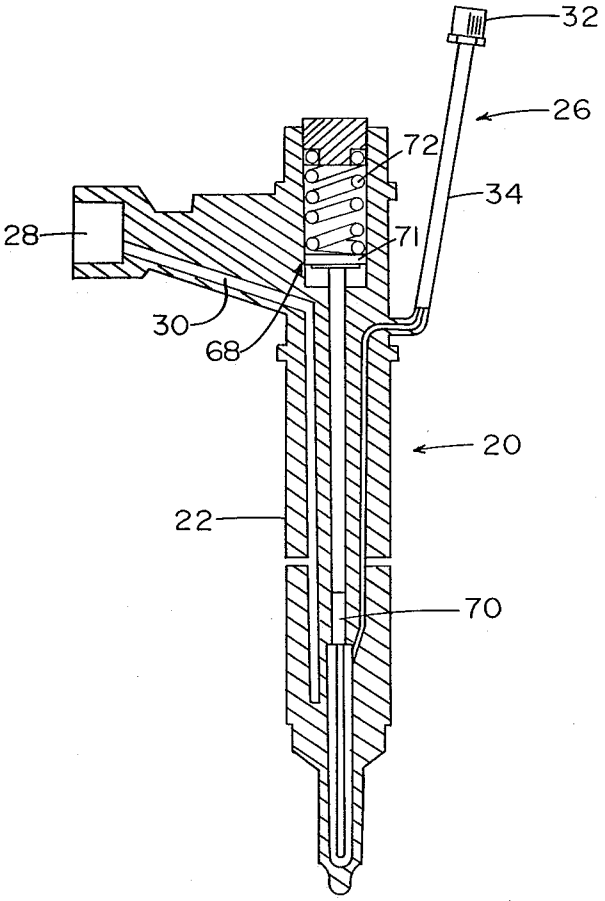
FIG. 3 is a partial cross-sectional view of the nozzle shown in FIG. 2.
Figure 2:
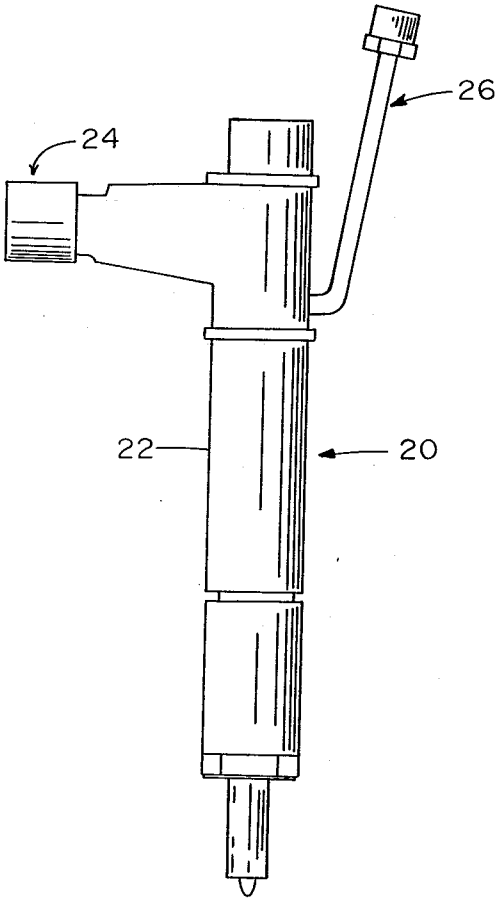
FIG. 2 is a side view of the fuel injection nozzle of the present invention showing respective fuel intake means and means for injecting the fuels into a chamber.

The present invention eliminates the need for a separate nozzle system to inject a pilot fuel. Referring to FIGS. 2 and 3, the fuel injection system 20 of the present invention includes a housing 22 having at least one primary fuel receiving means 24 and at least one pilot fuel receiving means 26. The primary fuel receiving means 24 includes an inlet port 28 and a passageway 30 leading to the center of the housing 22. It is preferred that the passageway 30 has a cross-sectional dimension less than that of the inlet port 28 in order to maintain or increase the pressure on the primary fuel flowing therethrough.

The pilot fuel receiving means 26 includes an inlet port 32 adapted to receive the pilot fuel from a pump (not shown) and to transport the pressurized pilot fuel through a fuel line 34 which exits into the housing 22 as explained hereinafter.

Figure 5:
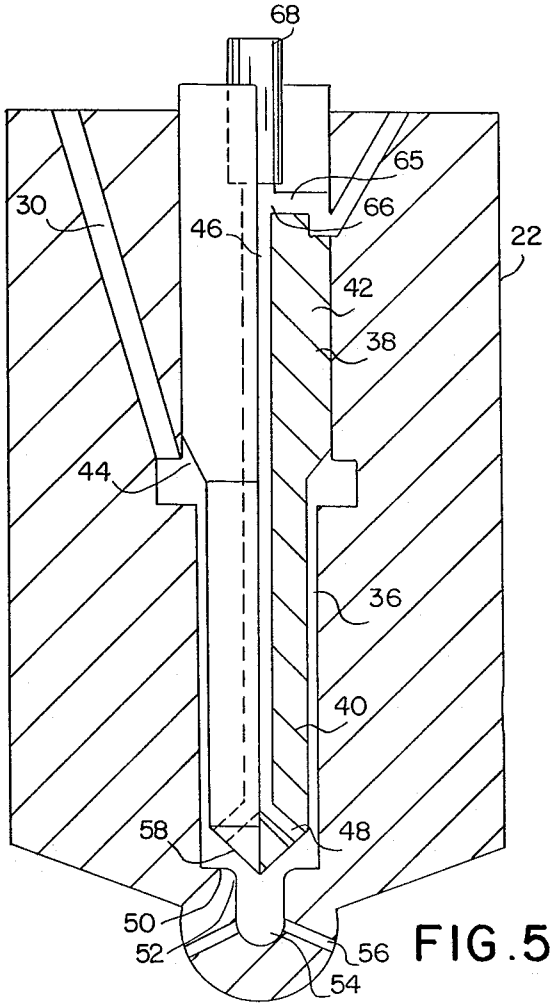
FIG. 5 is a cross-sectional view similar to FIG. 4 showing the valve means disengaged from the cavity wall to enable the fuel stored in the collection zone to be released under pressure through the injection means.
Figure 4:
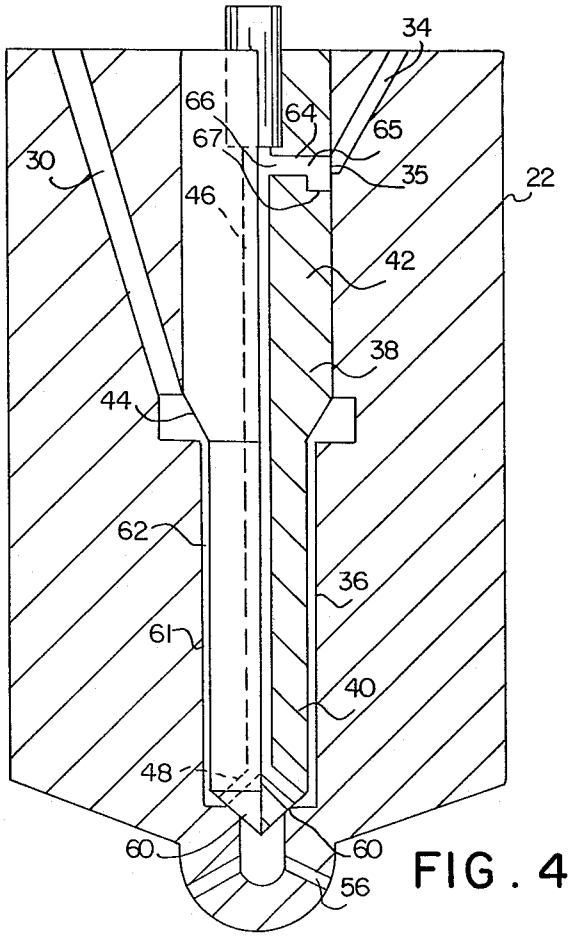
FIG. 4 is a cross-sectional view similar to FIG. 3 with the valve means in sealed relationship with the cavity wall to form a fuel collection zone above the seal.

As shown best in FIGS. 4 and 5, the housing 22 contains a centrally located cavity 36 having therein a valve 38. The valve 38 comprises a lower section 40, an upper section 42 and a wall 44 tapered inwardly from the upper section 40 to the lower section 42.

The valve 38 is also provided with an axial hole 46 extending from the upper section 42 to the bottom of the lower section 40. As shown specifically in the embodiment described in FIGS. 4 and 5, the axial hole 46 connects to a plurality of exit ports 48 which taper downwardly and away from the axial hole 46 and therefore provide a continuous pathway for the flow of the pilot fuel through the valve 38.

The bottom of the cavity 36 is provided with a shoulder 50 and an inwardly tapered lip 52 which defines a zone 54 for accumulation of the fuel before it is ejected out of the fuel injection system through a narrow series of spaced apart injection ports 56. The bottom of the valve 38 is provided with a tapered end 58 having a degree of taper complimentary to that of the lip 52 so that the lip 52 and the end 58 form a annular seal 60 when the valve is in the position shown in FIG. 4. In this sealed relationship, the lower section 40 of the valve 38 and the wall 61 of the cavity 36 adjacent thereto form an annular collection zone 62 positioned above the seal as explained hereinafter.

The valve 38 is also provided with means for conveying the pilot fuel from the fuel line 34 of the fuel receiving means 24 to the axial hole 46. This may be accomplished by providing the valve 38 with an annular groove 64 having an upper section 65 and a lower section 67 as shown best in FIG. 5. When the valve 38 is sealed against the lip 52, the fuel line 34 is aligned with the upper section 65 of the groove 64 as shown in FIG. 4. A hole 66 extends radially from the interior of the upper section 65 of the groove 64 to the axial hole 46 thereby providing a continuous pathway for the flow of the pilot fuel from the pump (not shown) into the valve 38. The fuel is readily able to flow through the axial hole 46, out of the exit ports 48 and into the collection zone 62. The flow of fuel ceases by the control of the remote pump.

It is desirable to provide the groove 64, the hole 66, the axial hole 46, and the exit ports 48 with decreasing cross-sectional dimensions in order to maintain or increase the pressure on the fuel as it flows toward the combustion chamber.

The valve 38 is also provided with a head 68 having a top surface 70 which engages a push rod 71 in the housing 22. The push rod 71 in turn engages a compression spring 72 in the upper portion of the housing 22 as shown best in FIG. 3. The valve 38 is therefore able to undergo limited upward movement in the cavity 36 as far as necessary so that it may disrupt the seal 60 to thereby release the fuel stored in the collection zone 62. Thereafter, when the fuel has been released, the spring 72 forces the valve 38 downward until the end 58 of the valve 38 again sealingly engages the lip 52.

Figure 6:
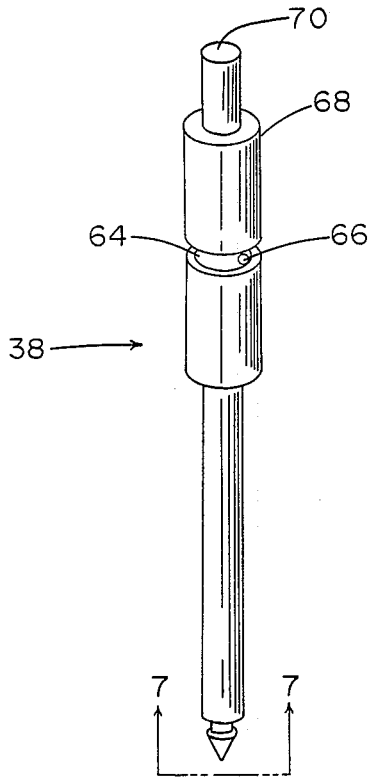
FIG. 6 is a perspective view of one embodiment of the valve means of the present invention.
Figure 7:
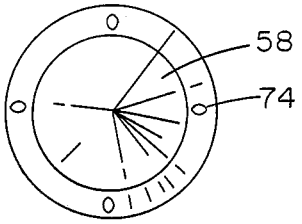
FIG. 7 is a cross-sectional view taken along line 7—7 of FIG. 6.
Figure 8:
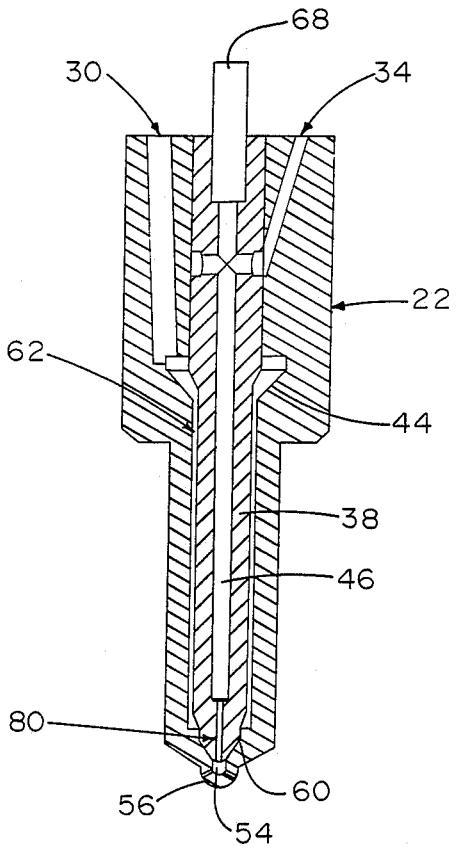
FIG. 8 is a cross-sectional view of another embodiment of the invention in which the fuel flowing through the nozzle is sent directly into a collection zone below the seal formed by the valve means and the cavity wall.

As shown in FIGS. 6 and 7, the pilot fuel is preferably ejected out of the valve 38 through a plurality of space-apart holes 74 under sufficient pressure so as to fill the collection zone 62. The diameter of the holes 74 is preferably no larger than the diameter of the axial hole 46, and is most preferably smaller so as to maintain or increase the pressure under which the pilot fuel is ejected into the zone 54 of the cavity 36.

In operation, the pilot fuel from a pump is sent under pressure through the fuel line 34 and the opening 35 via the annular groove 64 of the valve 38. At this time, the end 58 of the valve 38 is sealingly engaged to the lip 52.

The pressured pilot fuel is sent into the groove 64 and enters the hole 66 and flows into the axial hole 46. The pilot fuel flows out of the exit ports 48 into the collection zone 62. Eventually the collection zone 62 fills to capacity so that the fuel exerts an upward pressure against the tapered wall 44 connecting the upper and lower sections 40 and 42 of the valve 38.

The upward pressure forces the valve 38 to move from the sealed position shown in FIG. 4 to the unsealed position shown in FIG. 5. As a result, the seal around the collection zone 62 is disrupted and the fuel flows through the zone 54 and is injected into the combustion chamber via the injection ports 56.

Once the pilot fuel has been injected, the pressure against the tapered wall 44 is diminished to a point where the spring 72 forces the valve 38 via the push rod 71 downward until it once again sealingly engages the lip 52 of the cavity 36. At this point the primary fuel pump is activated to thereby send a pressurized flow of fuel through passageway 30 into the collection zone 62. The valve 38 is then operated in the same way as described above for the pilot fuel.

Specifically, the primary fuel exerts upward pressure against the tapered wall 44 causing the valve 38 to lift and thereby release the fuel into the zone 54 and out the injection ports 56. When the pressure is released by the evacuation of the primary fuel, the spring 72 forces the valve 38 downward until the seal is reestablished for operation of the next pilot fuel cycle or for another injection of primary fuel.

In another embodiment of the invention only the primary fuel is sent to the collection zone 62 while the pilot fuel is sent directly from the axial channel 46 into the zone 54. This embodiment provides better separation between the fuels because the pilot fuel is isolated from the primary fuel collection area 62 by the seal 60 which remains intact during collection and evacuation from the zone 54.

More specifically, the pilot fuel is sent through the axial hole into a passageway 80 directly into the collection zone 54 and out of the injection ports 56. During collection and evacuation of the pilot fuel from the zone 54, the seal 60 between the valve 38 and the cavity 36 is maintained. The primary fuel is then sent into the collection zone 62 until sufficient pressure is generated upwardly against the valve 38 to disrupt the seal 60 as described in connection with FIGS. 4 and 5. The primary fuel is then injected into the chamber through the injection ports 56 and subsequently the valve 38 moves into sealing engagement with the lip 52 of the cavity 36.

Thus, the pilot fuel is prevented from mixing with residual primary fuel which may be in the collection zone 62.

It will be understood that in accordance with the invention the primary fuel may be supplied through the valve and the pilot fuel supplied from the position exterior of the valve.

What we claim is:

1. A fuel injection nozzle for an engine having at least one compression-ignition combustion chamber comprising:

(a) a first intake means for receiving a charge of a first fuel and a second intake means for receiving a charge of a second fuel;

(b) a cavity having respective openings for receiving said first and second charged fuels from the respective intake means;

(c) valve means movable within the cavity and adapted to sealingly engage a wall of the cavity to form at least one collection zone for collecting said fuels received from said openings and to disengage from the wall of the cavity to thereby release said fuels, said valve means comprising means for conveying one of said fuels from one of said openings to said collection zone; and (d) injection means adapted to receive the fuels from the at least one collection zone and to release said fuels into said combustion chamber.

2. The nozzle of claim 1 comprising a single collection zone circumscribing the valve means and being formed by the sealing engagement of the wall of the cavity and the outersurface of the valve means.

3. The nozzle of claim 1 wherein said valve means further comprises:

(a) a body having a top end, a bottom end and a surface adapted to sealingly engage the wall of the cavity;

(b) a groove circumscribing said body and adapted to receive one of said fuels from one of the openings in the cavity;

(c) a passageway within the body in flow communication with the groove; and (d) at least one exit port in flow communication with the passageway for passing said fuel from the passageway within the body to the collection zone.

4. The nozzle of claim 3 wherein the groove has an upper section adapted to be in flow communication with one of said intake means to provide a pathway for the flow of one of said fuels through the valve means when the valve means is engaged by the wall of the cavity to form said at least one collection zone, and a lower section in communication with the intake means when the valve means is disengaged from the wall of the cavity wherein said fuel is prevented from flowing through the valve means.

5. The nozzle of claim 1 wherein the injection means comprises a plurality of spaced apart holes adapted to emit fine droplets of fuel into the compression-ignition engine combustion chamber.

6. The nozzle of claim 3 wherein the exit port comprises a plurality of spaced apart holes.

7. The nozzle of claim 1 further comprising stop means for preventing unlimited movement of the valve means away from the cavity wall after the valve means has disengaged from the cavity wall.

8. The nozzle of claim 3 wherein the body of the valve means comprises an upper section and a lower section having a smaller cross-sectional area than the upper section and an annular tapered wall extending from the upper to the lower section, said tapered wall serving as a boundary of the collection zone.

9. The nozzle of claim 1 wherein the valve means is adapted to convey multiple charges of one of said fuels to the combustion chamber.

10. The nozzle of claim 1 wherein the first fuel is a adapted to autoignite under the conditions prevailing in the combustion chamber.

11. The nozzle of claim 1 comprising two collection zones separated by the removable seal formed between the valve means and the wall of the cavity, one of said collection zones adapted to receive the first fuel and being in flow communication with the injection means when the valve means is sealed against the cavity wall and the other collection zone adapted to receive the second fuel.

12. The nozzle of claim 11 wherein the first fuel is a fuel adapted to autoignite under the conditions prevailing in the combustion chamber.

13. The nozzle of claim 12 wherein the valve means comprises:

(a) a body having a top end, a bottom end and a surface adapted to sealingly engage the wall of the cavity;

(b) a groove circumscribing said body and adapted to receive the autoignitable fuel from one of the openings of the cavity; and (c) a passageway within the body in flow communication with the groove and opening into one of said collection zones in flow communication with the injection means.

14. A valve adapted for use in a fuel injection nozzle comprising:

(a) a body having an upper and lower section;

(b) an annular channel circumscribing a portion of the upper section and having at least one hole therein;

(c) an axial hole within the body connected to the hole in the annular channel and extending to the lower section of the body, said axial hole providing an unobstructed pathway for the flow of a combustible fuel therethrough; and (d) at least one hole exiting the lower section of the body and connected to the axial hole to thereby provide a continuation of the unobstructed pathway for the flow of the combustible fuel through the valve.

15. The valve of claim 14 wherein the upper section of the body has a cross-sectional dimension greater than the cross-sectional dimensions of the lower section of the body, said sections being connected by an annular tapered wall.

16. The valve of claim 14 wherein the annular channel comprises an upper section and a lower section, said upper section being in flow communication with the axial hole within the body to provide a pathway for the flow of said fuel through the valve.

17. The valve of claim 14 wherein the hole in the annular channel extends radially toward the upper section of the body and the axial hole within the body is substantially perpendicular to the annular channel.

* * * * *